US006974353B2

(12) United States Patent
Liu et al.

(10) Patent No.: US 6,974,353 B2
(45) Date of Patent: Dec. 13, 2005

(54) CABLE END CONNECTOR ASSEMBLY

(75) Inventors: Huang-Hsin Liu, Tu-Chen (TW); Jie Cheng, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/998,884

(22) Filed: Nov. 29, 2004

(65) Prior Publication Data

US 2005/0124227 A1 Jun. 9, 2005

(30) Foreign Application Priority Data

Dec. 3, 2003 (CN) ..... 200320120257

(51) Int. Cl.[7] ..... H01R 13/64

(52) U.S. Cl. ..... 439/680; 439/677; 439/382

(58) Field of Search ..... 439/680, 677, 439/606, 382, 383

(56) References Cited

U.S. PATENT DOCUMENTS

| | | | | |
|---|---|---|---|---|
| 5,445,534 | A | 8/1995 | Ishizuka | |
| 6,585,536 | B1 | 7/2003 | Wu | |
| 6,653,569 | B1 * | 11/2003 | Sung | 174/88 R |
| 6,758,694 | B2 * | 7/2004 | Liu | 439/606 |
| 6,846,188 | B2 * | 1/2005 | Hsin et al. | 439/79 |

* cited by examiner

*Primary Examiner*—Tho D. Ta
(74) *Attorney, Agent, or Firm*—Wei Te Chung

(57) ABSTRACT

A cable end connector assembly (1) includes an insulative housing (10), a number of contacts (60) received in the insulative housing, a cable (50) electrically connecting with the contacts, a casing (20) defining a slot (22) in one side, a cover (40) enclosing the insulative housing and the cable, and a positioning member (30). The insulative housing includes a guiding protrusion (14) projecting outwardly from an outer surface thereof. The positioning member includes an arm portion (31) defining a receiving cavity (32) for receiving the guiding protrusion therein, a positioning portion (33) having an engaging bar (330) received in the slot of the casing, and a middle portion (34) connecting the arm portion and the positioning portion.

12 Claims, 3 Drawing Sheets

CABLE END CONNECTOR ASSEMBLY

BACKGROUND OF THE INVENTION

1. Field of the Invention

The present invention generally relates to a cable end connector assembly, and particularly to a cable end connector assembly having a positioning member.

2. Description of Prior Art

There exists in the art an electrical connector known as a Serial Advanced Technology Attachment (Serial ATA) connector which is generally used for disk drives and storage peripherals. Especially, the Serial ATA connectors according to the Serial ATA standard are featured in fewer electrical contacts than other conventional electrical connectors and are relatively tiny in configuration. The standard Serial ATA device plug connector comprises an L-shaped blade with a plurality of contacts disposed thereon for being inserted into corresponding L-shaped receiving slot of a standard Serial ATA receptacle connector of a cable end connector assembly. A guiding post and a guiding slot are respectively disposed on the standard plug connector and the standard receptacle connector for guiding the insertion therebetween. The dimensions of the guiding slot and the guiding post are described in detail in the description of the Serial ATA standard, though the standard receptacle connector is not initially designed to mate with the standard plug connector. In application, when the guiding post of the plug connector is guided into the guiding slot, there commonly exits a gap therebetween, which would result in unstable mating connection between the standard plug connector and the standard receptacle connector, and thereby adversely affecting the mating between the standard plug connector and the cable end connector assembly.

Hence, an improved cable end connector assembly is highly desired to overcome the advantages presented in the prior art.

BRIEF SUMMARY OF THE INVENTION

Accordingly, it is an object of the present invention to provide a cable end connector assembly having an positioning member for securing the cable end connector assembly with a mating complementary connector.

In order to achieve the above-mentioned object, a cable end connector assembly in accordance with the present invention comprises an insulative housing, a number of contacts received in the insulative housing, a cable electrically connecting with the contacts, a casing defining a slot in one side, a cover enclosing the insulative housing and the cable, and a positioning member. The insulative housing comprises a guiding protrusion projecting outwardly from an outer surface thereof. The positioning member comprises an arm portion defining a receiving cavity for receiving the guiding protrusion therein, a positioning portion having an engaging bar received in the slot of the casing, and a middle portion connecting the arm portion and the positioning portion.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
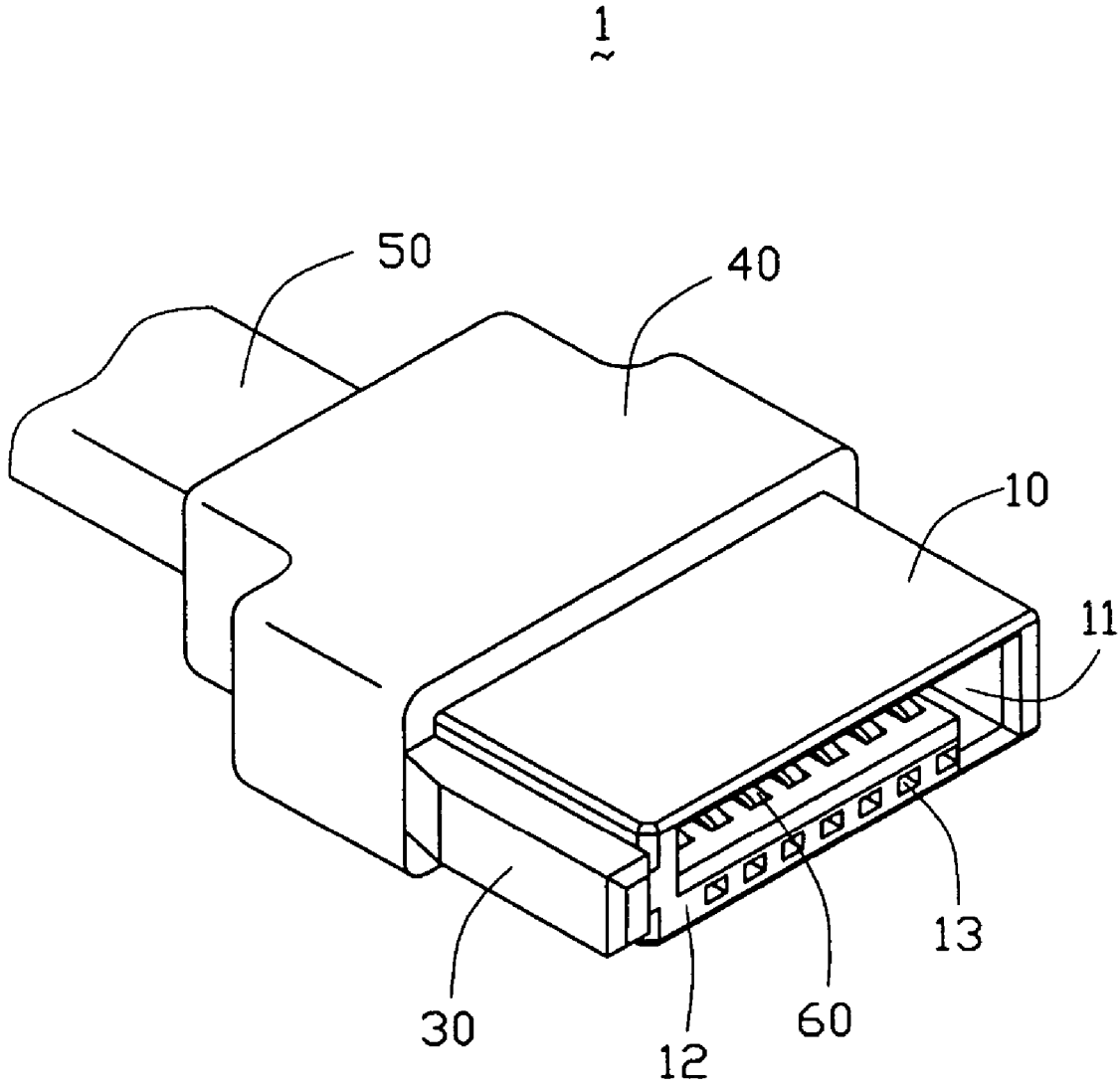
FIG. 1 is a perspective view of a cable end connector assembly in accordance with the present invention.

Reference will now be made to the drawing figures to describe the present invention in detail.

With reference to FIG. 1, a cable end connector assembly 1 in accordance with the present invention is adapted for mating with a complementary connector (not shown) and satisfies Serial Advanced Technology Attachment (Serial ATA) standard.

Figure 2:
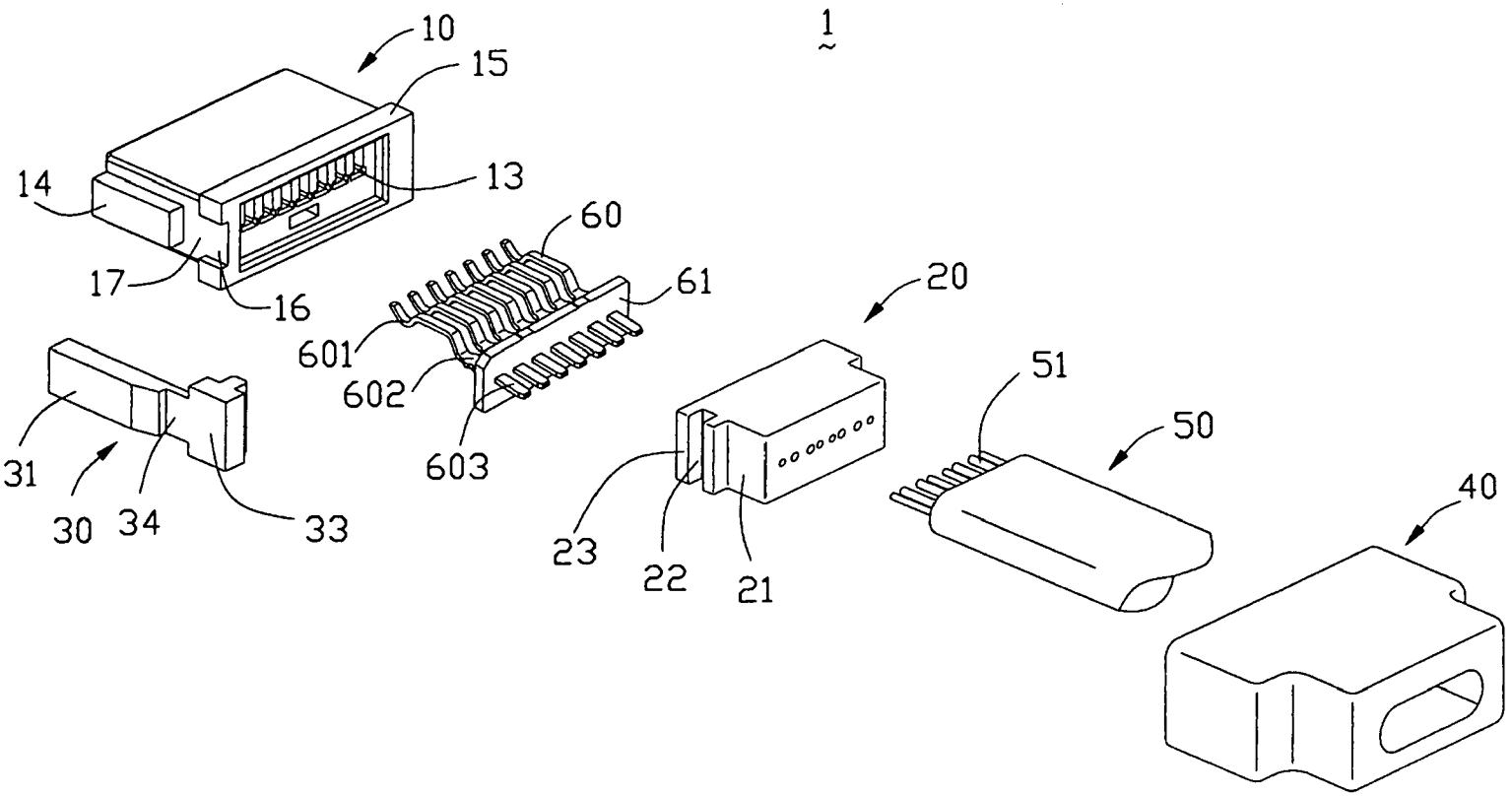
FIG. 2 is an exploded, perspective view of the cable end connector assembly.
Figure 3:
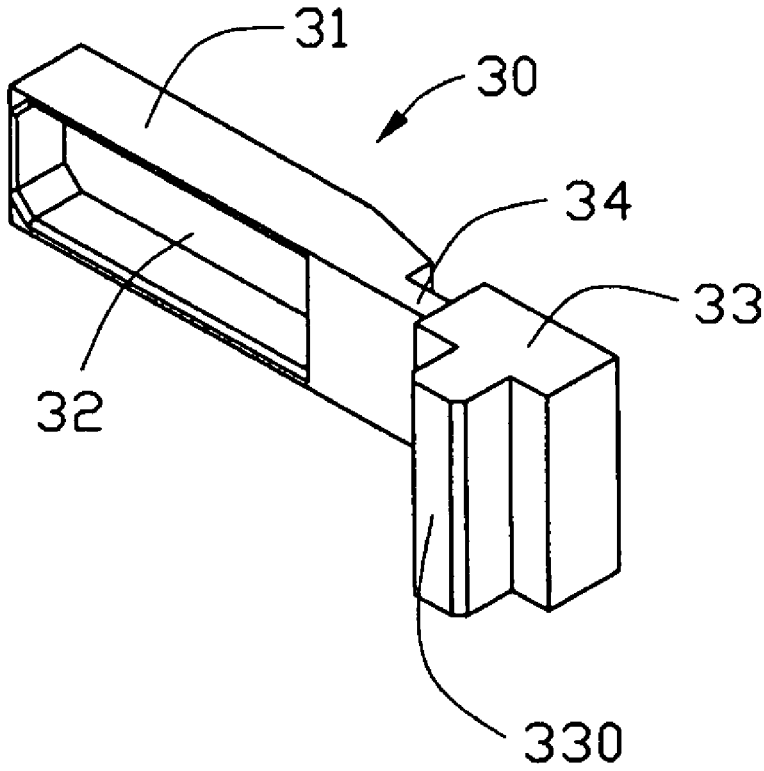
FIG. 3 is a perspective view of a positioning member of the cable end connector assembly.

Referring to FIGS. 2 and 3 in conjunction with FIG. 1, the cable end connector assembly 1 comprises an insulative housing 10, a plurality of contacts 60, a casing 20, a positioning member 30, a cover 40 and a cable 50. The insulative housing 10 is formed with an L-shaped receiving space 11 at a front end thereof, a lower wall 12 defining a plurality of passageways 13 extending therethrough, and a side wall 17. A guiding protrusion 14 projects outwardly from an outer surface of the side wall 17. A flange 15 projects outwardly at a rear end of the insulative housing 10 with a cutout 16 being defined behind the guiding projection 14.

Each contact 2 has an intermediate portion 602, a contacting portion 601 and a soldering tail 603 respectively extending from opposite ends of the intermediate portion 602. The contacting portions 601 of the contacts 60 are received in the passageways 13 of the insulative housing 10 for contacting with corresponding terminals (not shown) of the complementary connector. A rectangular spacer 61 is attached rear ends of the intermediate portions 602 for organizing and isolating the contacts 2.

The cable 50 comprises a plurality of conductors 51 exposed outside for connecting with the soldering tail 603 of the contacts 60.

The casing 20 is attached to a junction where the contacts 60 and the conductors 51 of the cable 50 are connected. The casing 20 comprises a pair of bars 23 projecting outwardly from a side wall 21 thereof. A slot 22 is defined between the bars 23.

The positioning member 30 is made of plastic in the preferred embodiment and comprises an arm portion 31, a positioning portion 33 and a middle portion 34 connecting the arm portion 31 and the positioning portion 33. The inner surfaces of the arm portion 31 and the middle portion 34 are coplanar with each other and are not coplanar with an inner surface of the positioning portion 33. A receiving cavity 32 is defined in an inner side of the arm portion 31 and is shaped to accommodate the guiding protrusion 14. The positioning portion 33 is formed with an engaging bar 330 projecting from an inner side thereof for engagement with the slot 22 of the casing 20.

The cover 40 encloses the casing 20, a front end of the cable 50, a rear end of the insulative housing 10, and a rear end of the positioning member 30 and defines an entrance (not labeled) to let the cable 50 pass through.

In assembly, the conductors 51 of the cable 50 are first soldered to the contacts 60, which are exposed outside the insulative housing 10. The casing 15 is attached to the solder connecting portion between the cable 50 and the contacts 60. The positioning member 30 is then assembled to the insulative housing 10 and the casing 20, with the engaging bar 330 thereof being received in the slot 22 of the casing 20 and the middle portion 34 being received in the opening 16 of the insulative housing 10. The guiding protrusion 14 of the insulative housing 10 is fittingly received in the receiving cavity 32 of the arm portion 31. The cover 30 is provided after the insulative housing 10, the contacts 60, the cable 50 and the casing 20 are assembled together.

When the cable end connector assembly 1 engages with the complementary connector, the positioning member 30 and the guiding protrusion 14 are received in a guiding slot of the complementary connector. The dimensions of the cable end connector assembly 1 and the complementary connector coincide with Serial ATA standard. Therefore, without changing dimensions thereof, the cable end connector assembly 1 and the complementary connector could engage with each other tightly so as to assure the stability of the signal/power transmission therebetween.

In the preferred embodiment, the positioning member 30 is engaged with the insulative housing 10 and the casing 20. However, in alternative embodiments, the positioning member 30 could be engaged with only one of them. Furthermore, when the positioning member 30 is only engaged with the insulative housing 10, the present invention is effective without the casing 20.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A cable end connector assembly for mating with a complementary connector, comprising:

an insulative housing defining an L-shaped receiving space, a plurality of passageways extending therethrough, and a guiding protrusion projecting outwardly from an outer surface thereof;

a plurality of contacts received in the passageways;

a cable comprising a plurality of conductors electrically connecting with corresponding contacts;

a cover overmolded on a rear end of the insulative housing and a front end of the cable; and a positioning member engaging with the guiding protrusion;

wherein the positioning member comprises an arm portion defining a receiving cavity in a front end thereof, and the guiding protrusion of the insulative housing is received in said receiving cavity.

2. The cable end connector assembly as described in claim 1, wherein the arm portion of the positioning member is exposed outside the cover.

3. The cable end connector assembly as described in claim 1, wherein the positioning member comprises a positioning portion in a rear end thereof and a middle portion connecting the positioning portion and the arm portion.

4. The cable end connector assembly as described in claim 3, wherein the insulative housing comprises a flange in the rear end thereof, the flange defining an opening behind the guiding protrusion for receiving the middle portion of the positioning member.

5. The cable end connector assembly as described in claim 3, wherein the positioning portion of the positioning member is formed with an engaging bar.

6. The cable end connector assembly as described in claim 5, further comprising a casing covering a junction where the contacts and the conductors are connected, and wherein the casing defines a slot receiving the engaging bar.

7. A cable end Serial Advanced Technology Attachment (Serial ATA) connector assembly for mating with a complementary connector, comprising:

an insulative housing defining an L-shaped receiving space, a plurality of passageways extending therethrough, and a guiding protrusion projecting outwardly from an lengthwise end surface thereof, said projection being configured with a standard dimension;

a plurality of contacts received in the passageways;

a cable comprising a plurality of conductors electrically connecting with corresponding contacts;

a cover overmolded on a rear end of the insulative housing and a front end of the cable; and a discrete positioning member defining a cavity in compliance with the protrusion and covering the protrusion to form an increased dimension thereof so that the protrusion with the positioning member thereon is no longer of a standard dimension but of an enlarged dimension for reinforced coupling between the cable end connector and the complementary connector.

8. The cable end connector assembly as claimed in claim 7, wherein said positioning member is integrally fastened to the cover via overmolding.

9. The cable end connector assembly as claimed in claim 7, wherein a casing is enclosed in the cover and formed prior to said cover, and said positioning member is latchably engaged with the casing.

10. A method of making a cable end Serial Advanced Technology Attachment (Serial ATA) connector assembly comprising steps of:

(a) providing a standard housing with a standard L-shaped mating port and a standardized protrusion on a lateral side of the housing;

(b) disposing a plurality of contacts into the housing;

(c) connecting a plurality of wires to the contacts;

(d) providing a positioning member with a cavity compliant with a contour of said protrusion;

(e) covering said protrusion with said positioning member so as to form an enlarged non-standard protrusion for reinforced coupling with a complementary connector; and (f) overmolding a cover to the housing and the wires.

11. The method as claimed in claim 10, before said step (d), further includes a step (c') overmolding a casing grasping the wires, and the cover also encloses said casing.

12. The method as claimed in claim 11, wherein said positioning member is engaged with the casing.

* * * * *